US008161899B1

(12) United States Patent
Smallin

(10) Patent No.: US 8,161,899 B1
(45) Date of Patent: Apr. 24, 2012

(54) MULTIPLE TORPEDO MINE

(75) Inventor: Bryan Smallin, Panama City, FL (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 895 days.

(21) Appl. No.: 12/283,778

(22) Filed: Sep. 11, 2008

(51) Int. Cl.
*B63B 1/00* (2006.01)

(52) U.S. Cl. ..... 114/238; 89/1.81; 89/1.11; 102/406

(58) Field of Classification Search ..... 114/238; 89/1.81, 1.11; 102/406
See application file for complete search history.

(56) References Cited

U.S. PATENT DOCUMENTS 467,793 A * 1/1892 Elliott ..... 102/416
709,335 A * 9/1902 Lake ..... 114/319
713,198 A * 11/1902 Brady ..... 114/238
1,430,644 A * 10/1922 Hammond, Jr. et al. ..... 114/238
3,106,905 A * 10/1963 Gondek ..... 114/238
3,137,203 A * 6/1964 Brown ..... 89/1.81
3,145,617 A * 8/1964 Gondek ..... 89/1.1
3,811,379 A * 5/1974 Sondheimer ..... 102/413
4,003,291 A * 1/1977 Vass et al. ..... 89/1.81
4,215,630 A * 8/1980 Hagelberg et al. ..... 89/1.11
4,395,952 A * 8/1983 Hickey ..... 102/411
4,566,367 A * 1/1986 Hickey ..... 89/1.81
4,586,421 A * 5/1986 Hickey et al. ..... 89/1.81
5,208,422 A * 5/1993 Moody ..... 89/1.809
5,363,791 A * 11/1994 Stallard, III ..... 114/318
5,495,819 A * 3/1996 Marion ..... 114/238
5,542,333 A * 8/1996 Hagelberg et al. ..... 89/1.81
5,666,897 A * 9/1997 Armstrong ..... 114/20.1
5,666,900 A * 9/1997 Carroll et al. ..... 114/316
5,828,571 A * 10/1998 Bessacini et al. ..... 701/23
5,844,159 A * 12/1998 Posseme et al. ..... 89/1.13
5,944,762 A * 8/1999 Bessacini et al. ..... 701/27
6,006,145 A * 12/1999 Bessacini ..... 701/1
6,044,745 A * 4/2000 Hickey ..... 89/1.809
6,079,347 A * 6/2000 Lieb ..... 114/238
6,112,667 A * 9/2000 Bailey et al. ..... 102/411
6,220,196 B1 * 4/2001 Escarrat ..... 114/238
6,305,263 B1 * 10/2001 Wallin ..... 89/5
6,376,762 B1 * 4/2002 French et al. ..... 114/22
6,418,870 B1 * 7/2002 Lanowy et al. ..... 114/238
6,487,952 B1 * 12/2002 Borgwarth et al. ..... 89/1.81
6,701,819 B1 * 3/2004 Williams et al. ..... 89/1.81
6,854,409 B1 * 2/2005 Galliano ..... 114/238
6,871,610 B1 * 3/2005 Galliano ..... 114/238
6,904,859 B1 * 6/2005 Gieseke ..... 114/238
6,932,016 B1 * 8/2005 Gieseke ..... 114/238
7,140,289 B1 * 11/2006 Ansay et al. ..... 89/1.809

(Continued)

*Primary Examiner* — Michelle Clement
(74) *Attorney, Agent, or Firm* — James T. Shepherd

(57) ABSTRACT

A multiple torpedo mine is capable of launching multiple torpedoes in water simultaneously or at predetermined intervals. The mine has an elongate container having multiple launch tubes with launch tube covers and each containing a torpedo. A programmable target detection sensor unit in the elongate container senses impinging stimuli indicative of an approaching target and generates representative target signals. A main controller in the elongate container is coupled to receive the target signals from the target detection sensor unit, and the main controller is preprogrammed to recognize targets of interest and generate appropriate launch control signals for the torpedoes. A launching system in the elongate container is coupled to the main controller and each of the launch tubes to feed high pressure gas to the base and interior of the launch tubes to launch the torpedoes into the water.

14 Claims, 2 Drawing Sheets

U.S. PATENT DOCUMENTS

| | | | | |
|---|---|---|---|---|
| 7,243,609 | B1 * | 7/2007 | Ansay et al. | 114/316 |
| 7,418,914 | B2 * | 9/2008 | Ansay et al. | 114/239 |
| 7,874,091 | B2 * | 1/2011 | Fu et al. | 42/1.14 |
| 7,882,775 | B2 * | 2/2011 | Martinez et al. | 89/1.34 |
| 2002/0170419 | A1 * | 11/2002 | Borgwarth et al. | 89/1.81 |
| 2004/0069135 | A1 * | 4/2004 | Fowler | 89/1.805 |
| 2007/0051233 | A1 * | 3/2007 | Duge | 89/1.13 |
| 2009/0084284 | A1 * | 4/2009 | Martinez et al. | 102/504 |
| 2010/0000463 | A1 * | 1/2010 | Root, Jr. | 114/316 |
| 2011/0005373 | A1 * | 1/2011 | Martinez et al. | 89/1.34 |
| 2011/0005374 | A1 * | 1/2011 | Martinez et al. | 89/1.34 |
| 2011/0030540 | A1 * | 2/2011 | Martinez et al. | 89/1.34 |

* cited by examiner

MULTIPLE TORPEDO MINE

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

This invention is a mine capable of neutralization of at least one target with multiple torpedoes. More particularly, this multiple torpedo mine uses the same sensors, control system, container, and launch system repeatedly for launching multiple torpedoes at one or more targets.

Contemporary methods of mining waterways or expanses of open water have mines deployed and moored to the bottom, and each mine has a single warhead for a single anticipated target. Most of these mines required, the target ship to contact or come in close proximity to the mine to be effective. In addition, since the target might not come close to more than one mine, a single detonating mine might not be sufficient to disable the target.

An improvement over the stationary mine used a bottom moored mine having a single torpedo and associated sensor package. This improvement was known as the MK 60 Captor Mine, but it was limited since its single torpedo had only one warhead for one target, and was incapable of neutralizing larger targets because sometimes multiple mines could be needed for this task.

Thus, in accordance with this inventive concept, a need has been recognized in the state of the art for a multiple torpedo mine using the same sensors, control system, container, and launch system repeatedly for launching multiple torpedoes at one or more targets over an extended period of time to secure an area of a body of water.

SUMMARY OF THE INVENTION

The present invention provides a multiple torpedo mine for launching multiple torpedoes in water. The mine has an elongate container for multiple launch tubes that each have a launch tube cover at an outer end. Multiple torpedoes are in the container with a separate one of the torpedoes being in each of the launch tubes. A programmable target detection sensor unit in the container senses impinging stimuli indicative of an approaching target and generates representative target signals that are coupled to a main controller. The main controller is preprogrammed to recognize targets of interest to generate appropriate launch control signals for one or more torpedoes. A launching system in the container is coupled to the main controller and each of said launch tubes to feed high pressure gas to the base and interior of the designated launch tubes and the torpedoes contained in them to effect launch from the container and into the water.

A main protective top cover at a first end of the container covers all of the torpedoes and an anchor section is provided at the opposite end of the container. The launch tubes extend between the first and opposite ends of the container, and the launch tube covers are disposed inside of the main top cover. Connector devices releasably hold the main top cover on the container and release the main top cover to allow jettisoning of the main top cover from the container during tactical deployment of the mine into water. The programmable target detection sensor unit and launch tube covers are in contact with the water after the jettisoning of the main top cover from the container during tactical deployment of the mine into the water. The launch control signals are connected to the launching system from the main controller to activate the launching system to selectively initiate blowing of the launch tube covers off of one or more launch tubes to expose the contained torpedoes to the water. The main controller is preprogrammed to generate appropriate launch control signals to launch the torpedoes at substantially the same time and/or at designated intervals as tactically required.

An object of the invention is to provide a mine having multiple torpedoes for neutralizing one or more targets.

Another object of the invention is to provide a submerged moored mine sharing common sensors, controller, deployment system, and launching system for launching one or more torpedoes in different tactical solutions.

Another object of the invention is to provide a submerged multiple torpedo mine having an uninterrupted operational lifetime extending over a prolonged period of time for launching multiple torpedoes at one or more distant ship targets.

Another object of the invention is to provide a submerged multiple torpedo mine using common sensors, controller, deployment system, and launching system to launch one or more torpedoes at one or more differently sized ship-targets over an extended period.

These and other objects of the invention will become more readily apparent from the ensuing specification when taken in conjunction with the appended claims.

DESCRIPTION OF THE PREFERRED EMBODIMENT

Figure 1:
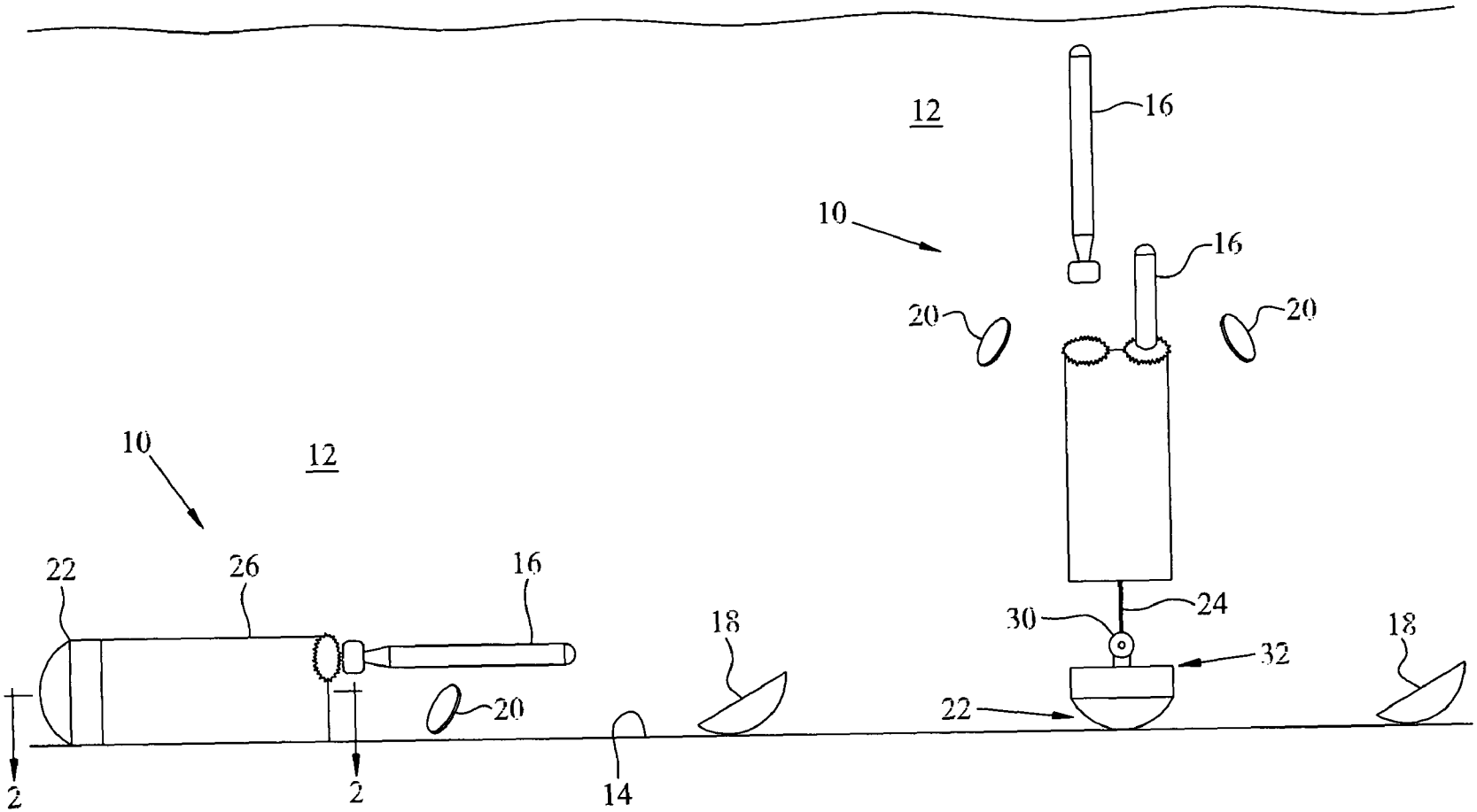
FIG. 1 is a schematic side view of two of the multiple torpedo mines of the invention deployed in a body of water.

Referring to FIG. 1, two multiple torpedo mines 10 of the invention are schematically depicted in two tactical deployment modes in a body of water 12. Mines 10 can be deployed from an aircraft or surface vessel to sink and lie on their sides to extend horizontally at the bottom 14 of a body of water 12 or mines 10 can extend vertically from bottom 14.

Multiple torpedo mine 10 shown on the left has a weight distribution to lie on its side in a horizontal tactical deployment on bottom 14 and has sufficient weight to be held or moored in place. This orientation of mine 10 allows the shallow water launch of at least one torpedo 16 at a detected target after both a main protective top cover 18 for the upper end of mine 10 and an individual protective launch tube cover 20 for each torpedo 16 have been jettisoned.

The other multiple torpedo mine 10 shown on the right may be preferred for a tactical deployment of mine 10 in deeper water 12. This vertical tactical deployment allows for a vertical launch of torpedoes 16, the launch of two torpedoes 16 at a detected target being depicted. As the mine 10 shown on the right is being deployed, it sinks to bottom 14. Next, a heavy anchor section 22 is released from mine 10 to rest on bottom 14, and a tether line 24 is extended from mine 10 to anchor section 22. The now buoyant remainder of mine 10 is held or moored some distance above anchor section 22 on bottom 14 in an upright alignment. After both main protective top cover 18 for the upper end of mine 10 and an individual protective launch tube cover 20 for each torpedo 16 have been jettisoned, mine 10 on the right can vertically launch torpedoes 16. Although deploying mine 10 to extend in vertical alignment is more likely to be used for deeper water applications and deploying mine 10 to extend in the horizontal disposition is more likely for shallower applications, either of these deployments can be used interchangeably as determined by the mission and the specific deployment selected is not a limitation of the invention.

Figure 2:
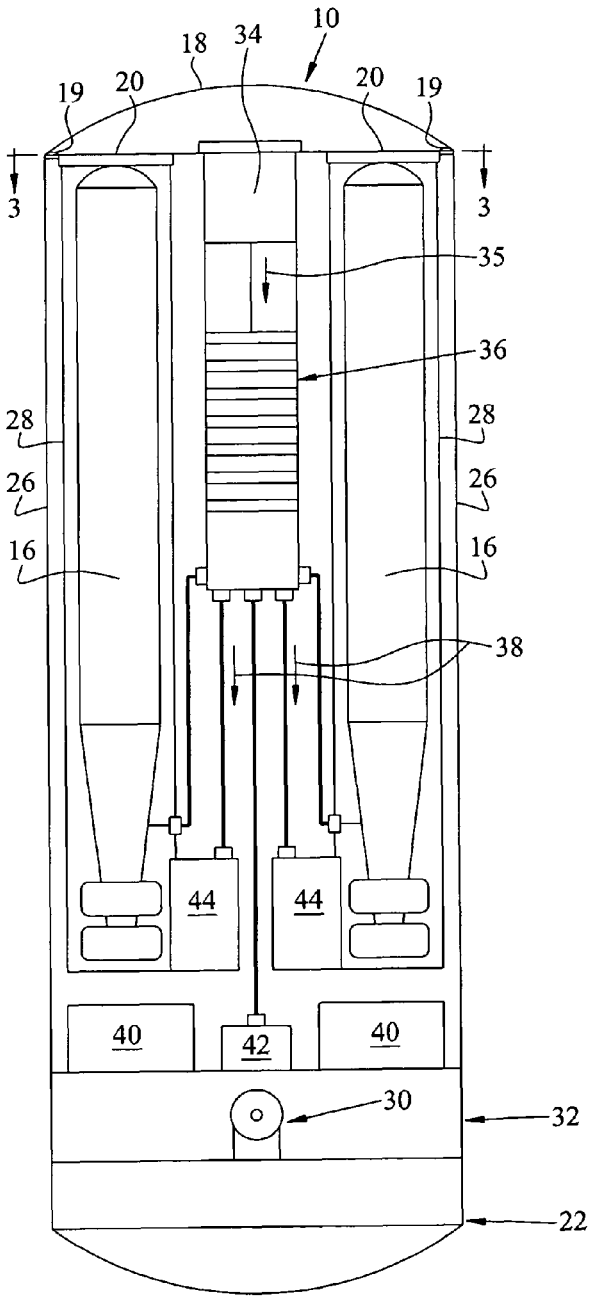
FIG. 2 is a cross-sectional schematic side view of the multiple torpedo mine taken generally along line 2-2 in the left mine in FIG. 1.
Figure 3:
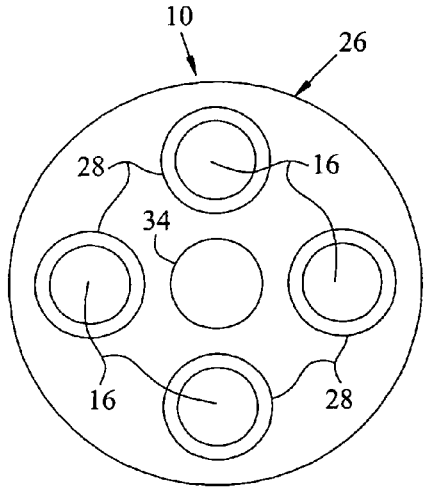
FIG. 3 is a top view of the multiple torpedo mine taken generally along line 3-3 in FIG. 2.

Referring also to FIGS. 2 and 3, mine 10 is provided with a strong, protective, elongate cylindrically-shaped container 26. Container 26 is capable of withstanding the shock and rigors associated with being launched into water 12 and dropped to bottom 14 and protecting the torpedoes 16 that are each housed in separate launch tubes 28. Container 26, launch tubes 28, and all the other structural parts of mine 10 are made from tough non-corrosive or corrosion resistant materials that are also designed or selected by those knowle'geable in the art to avoid magnetic, sonar and electromagnetic countermeasure detection.

Container 26 is closed by main protective top cover 18 that is secured to it by any of a number of well known connector devices 19 mounted on container 26. Connector devices 19 releaseably hold main cover 18 on container 26 and can be actuated as mine 10 is deployed into water 12 to release or separate main cover 18 from container 26 after a predetermined interval of time or by command when mine 10 is tactically deployed by dropping it into water 12. Separation of main cover 18 from container 26 exposes the separate individual launch tube covers 20 to the ambient environment. Since the interior of mine 10 can be positively pressurized, main cover 18 is assured of being jettisoned from container 26 when connector devices 19 are actuated. Launch tube covers 20 are appropriately retained on the ends of launch tubes 28 to seal and protect torpedoes 16 from the ambient water 12 until they are launched from mine 10.

Container 26 has a cable reel 30 in a deployment hardware section 32 at the bottom of container 26 to deploy tether line 24 that extends between container 26 and anchor section 22, as shown on the right in FIG. 1 and in FIG. 2. Depending on the tactical scenario, anchor section 22 can be separated from the base of elongate container 26 of mine 10 and remain at bottom 14 and tether line 24 can be extended from reel 30 to allow a vertical alignment of the remainder of container 26 at a predetermined distance above bottom 14 in a vertical tactical deployment of mine 10. Optionally, anchor section 22 can be kept with the rest of an appropriately ballasted mine 10 for a horizontal tactical deployment of mine 10 at bottom 14. The length of tether cable can be varied and pre-determined before deployment to accommodate different marine topography and tactical applications to provide greater tactical adaptability.

Container 26 houses the operatively interconnected programmable target detection sensor unit 34, main controller 36 including torpedo launcher initiation electronics, batteries 40 connected to a power distribution panel 42 that distributes electrical power throughout where needed in mine 10, and torpedo launching system 44. These components in container 26 are suitably fabricated and packaged to be capable of remaining reliably functional during deployment and deep water immersion in the harsh marine environment and remain operational for prolonged periods during possibly hostile countermeasures. Container 26 locates anchor section 22, cable reel 30, tether cable 24, and batteries 40 at its bottom to purposely be heavier on the bottom than the top of mine 10 to help assure the proper orientation after tactical deployment in the water.

Programmable target detection sensor unit 34 senses magnetic/seismic/pressure stimuli indicative or representative of an approaching target. A multitude of well known appropriate sensors for sensor unit 34 have been designed to respond to all known emerging modern day threats such as quiet diesel-electric submarines, mini-submarines, fast patrol boats, and air cushioned vehicles. For example, sensor unit 34 could incorporate the sensor unit in the MK 60 Captor Mine system referred to above to identify targets of interest. Target signals (shown as arrow 35 in FIG. 2) indicative of a detected target are generated by sensor electronics associated with sensor unit 34 and are coupled to main controller 36. Main controller 36 can be preprogrammed to recognize targets of interest and can generate appropriate launch control signals (shown as arrow 38) for launcher system 44 that is connected to each of launch tubes 28 to result in the launch of one or more torpedoes at substantially the same time or at designated intervals as required to neutralize the designated target (or targets) of interest. In other words, main controller 36 is preprogrammed to choose the appropriate torpedo or torpedoes 16 and sequence needed for the right fire control solution for the identified target and initiate launching system 44 to launch them from the individual launch tubes 28. Main controller 36 is also programmed to ignore signals from sensor unit 34 during the run time of the one or more launched torpedoes 16 to avoid wasting unneeded torpedoes on the same target. After engagement of a target, main controller unit 36 will reset the sensors of sensor unit 34 and wait for the next target against which the remaining torpedoes 16 in other launch tubes 28 of mine 10 can be deployed.

Launching system 44 can be much like that used in the referenced MK 60 Captor Mine system with the exception that it is coupled to multiple launch tubes 28 to be capable of selectively launching additional torpedoes 16 at the same or other targets. Launching system 44 includes explosive squib actuated $CO_2$ cartridges or other sources of other high pressurized gases operatively associated with each launch tube 28 that forcefully feed high pressure $CO_2$ or other gas to the base and interior(s) of selectively designated individual launch tubes 28 and the torpedoes 16 in them. At the same time, torpedo launcher initiation electronics of main controller 36 brings the designated torpedoes 16 online to be ready for immediate launch. Once each launch tube 28 is pressurized and each designated torpedo 16 is online, main controller 36 activates another explosive actuator of launcher system 44 that is associated with each designated launch tube 28 to blow each designated launch tube cover 20 off to expose the torpedoes 16 to ambient water 12. In other words, the launch control signals from main controller 36 additionally activates launching system 44 to blow launch tube covers 20 off of designated ones of individual launch tubes 28 to expose torpedoes 16 contained in each of them to ambient water 12. The pressurized $CO_2$ that was just coupled to each designated launch tube 28 ejects or launches the designated torpedo(s) 16 from mine 10 as shown by a single launched torpedo 16 in mine 10 shown in the left part or dual launched torpedoes 16 in mine 10 shown in the right part of FIG. 1.

An exemplary torpedo 16 that operates well in the multiple-torpedo mine 10 of the invention is the US NAVY MK 46 torpedo. The MK 46 is a compact and lightweight torpedo that has the test of time to back its performance. It is 12.75 inches in diameter by 102 inches long and weights approximately 518 pounds, and has a 98 pound warhead composed of PBXN-103 explosive. The MK 46 is sized and weighted right for mine 10 and includes a self-contained electrical power source, homing sensors, guidance system, controllable steering fins, and propulsion system to provide a high level of performance that makes it an ideal torpedo for mine 10 of the invention. Appropriate flotation and/or ballasting can be provided for within container 26 to assure that mine 10 containing multiple torpedoes 16 can be tactically deployed lying on its side on bottom 14 or extending in a vertical alignment above bottom 14. Other torpedo designs for the torpedoes 16 of mine 10 can be adapted and used as needed and as they are available with appropriate flotation/ballasting in mine 10 in accordance with this inventive concept.

Mine 10 of the invention is designed for offensive mining with the emerging modern day threats in mind. When deployed in a tactical scenario, mine 10 will either sit completely on the ocean floor or bottom 14 or anchored to the ocean floor with the main part of the mine floating in the water column. When a target is detected, at least one torpedo 16 is released. The uniqueness of mine 10 of the invention is that after releasing a single torpedo 16, it will still be operational because it carries a multiple number of torpedoes 16. Also, it can be programmed to release a multiple number of torpedoes 16 simultaneously or in sequence, depending on the target that mine 10 is configured or preprogrammed to sense and neutralize.

Operation of multiple torpedo mine 10 can begin when it is operationally planted or deployed by an air or marine craft, and target detection sensors 36 of mine 10 begin looking for the target(s) that the sensor unit 34 and main controller 36 are programmed to detect. Once a target is detected, signals 35 representative of the detected target are sent from target detection sensor unit 34 to main controller 36. Main controller 36 selects the required number of torpedoes 16 to launch to neutralize the target and activates launching system 44 to start the launch sequence. Launching system 44 initiates flooding of one or more launch tubes 28 with pressurized gas by activating the explosively actuated $CO_2$ cartridge for each tube. Virtually simultaneously, main controller 36 brings torpedo(s) 16 online through a fire control cable coupled to each torpedo 16. Once each selected launch tube 28 is pressurized and each torpedo 16 is running, a second explosive actuator (not shown) for each selected launch tube 28 releases each launch tube cover 20 and the pressurized gas in each selected launch tube 28 ejects and launches its contained torpedo 16 free from mine 10. After this launch of one or more torpedoes 16, mine 10 shuts down for a period of time while the launched torpedo (s) 16 home in on the target. This period of shutdown keeps mine 10 from launching any more torpedoes that might be unnecessary while each launched torpedo 16 homes in on its target using its own onboard targeting and guidance system.

After a predetermined period of time has elapsed, mine 10 turns back on and starts looking for targets again. If a large target is detected that requires more than one torpedo 16 to be used, the preprogramming in main controller 36 can effect the launch of more than one torpedo simultaneously or in a staggered sequence.

Mine 10 of the invention provides the capability of neutralizing multiple targets with a single deployed offensive system. Mine 10 has the capability of being reusable multiple times depending upon how many torpedoes are required to neutralize each target. Mine 10 additionally can launch multiple torpedoes 16 at the same time to engage larger targets in order to neutralize them. Even though there are multiple torpedoes 16 that can be separately launched at different times, mine 10 uses the same sensors, control system, container, and launch system repeatedly for each separate fire solution for each torpedo 16. This tactical capability gives a deployed mine 10 an added element of surprise and confusion to the enemy since another torpedo or multiple torpedoes can not only be launched at one or more target ships when they are first detected but torpedoes can be launched later over a period of time to secure a waterway.

Mine 10 of the invention can be modified and alternate embodiments may be adapted, and differently configured to accommodate differently shaped containers than the cylindrically-shaped elongate container 26 described for different operational conditions. While the exemplary embodiment shown in the figures has four launch tubes 28, the actual number of tubes selected and designed is limitless. All structural components of mine 10 can be made from a wide variety of tough non-corrosive or corrosion resistant materials that will hold up in the harsh marine environment. Mine 10 could be made in different shapes, and sizes and use sensor and computing systems other than those described to enable deployment of other types of ordnance to secure waterways for long durations.

The disclosed components and their arrangements as disclosed herein, all contribute to the novel features of this invention. Mine 10 of the invention is an uncomplicated and reliable application of known reliable components coupled with good engineering for improving long term operational readiness and effectiveness for securing a waterway for extended periods of time. Therefore, mine 10 of the invention, as disclosed herein is not to be construed as limiting, but rather, is intended to be demonstrative of this inventive concept.

It should be readily understood that many modifications and variations of the present invention are possible within the purview of the claimed invention. It is to be understood that within the scope of the appended claims the invention may be practiced otherwise than as specifically described.

I claim:

1. A mine for launching multiple torpedoes in water comprising:

an elongate container having at least two launch tubes, each of said launch tubes having launch tube cover at an outer end;

one torpedo contained in each of said launch tubes;

a programmable target detection sensor unit in said elongate container configured to sense impinging stimuli indicative of an approaching target and to generate representative target signals;

a main controller in said elongate container coupled to receive said target signals from said target detection sensor unit, said main controller being preprogrammed to recognize targets of interest from said target signals and to generate appropriate launch control signals for one or more of said torpedoes;

a launching system in said elongate container coupled to said main controller and each of said launch tubes to feed high pressure gas to the base and interior to selected ones of said launch tubes and said torpedoes contained in them to effect launch from said elongate container into said water;

a main protective top cover at a first end of said elongate container covering all of said torpedoes; and an anchor section at the opposite end of said elongate container, said launch tubes extending between said first and opposite ends of said elongate container;

wherein said launch tube covers are disposed inside said main top cover.

2. The mine of claim 1 further comprising:

connector devices for releaseably holding said main top cover on said elongate container, said connector devices configured to be released to allow jettisoning of said main top cover from said elongate container during tactical deployment of said mine into said water.

3. The mine of claim 2 wherein said programmable target detection sensor unit and said launch tube covers are in contact with said water after said main top cover is jettisoned from said elongate container during tactical deployment of said mine into said water.

4. The mine of claim 3 wherein said launch control signals are connected to said launching system to activate said launching system to blow selected launch tube covers off one or more of said launch tubes to expose said torpedoes contained therein to said water.

5. The mine of claim 4 further comprising:

a deployment hardware section mounted within said elongate container, wherein said deployment hardware section includes a cable reel and a tether line deployable therefrom and attached to said anchor section; and wherein said anchor section is releasably coupled to said elongate container at said opposite end.

6. The mine of claim 5 further comprising:

at least one battery disposed in said elongate container and interconnected to provide power to said sensor unit, said main controller, said cable reel and said launching system.

7. The mine of claim 4 wherein said main controller is preprogrammed to generate appropriate launch control signals to selectively launch multiple torpedoes simultaneously or at intervals.

8. A method of launching multiple torpedoes from a single mine in water comprising the steps of providing an elongate container having multiple launch tubes, each of said launch tubes having a launch tube cover at an outer end;

containing one torpedo in each of said launch tubes;

tactically deploying said elongate container at the bottom in of a body of water sensing impinging stimuli indicative of an approaching target with programmable target detection sensor unit in said elongate container;

generating target signals representative of said impinging stimuli indicative of an approaching target in said programmable target detector sensor;

coupling said target signals to a main controller in said elongate container;

generating appropriate launch control signals in said main controller unit for selectively launching one or more of said torpedoes;

feeding high pressure gas to the base and interior of selected ones of said launch tubes and said torpedoes contained in them by a launching system in response to said launch control signals to effect launch of said torpedoes from said elongate container into said water;

covering a first end of said elongate container and all of said torpedoes with a main protective top cover;

mounting an anchor section at an opposite end of said elongate container; and extending said launch tubes in-between said first and opposite ends of said elongate container, said launch tube covers being disposed inside of said main top cover.

9. The method of claim 8 further comprising the steps of:

releaseably holding said main top cover on said elongate container with connector devices; and jettisoning said main top cover from said elongate container by releasing said connector devices during tactical deployment of said mine into said water.

10. The method of claim 9 further comprising the step of:

immersing said programmable target detection sensor unit and said launch tube covers in said water after said step of jettisoning said main top cover from said elongate container during tactical deployment of said mine into said water.

11. The method of claim 10 further comprising the step of:

activating said launching system with said launch control signals from said main controller to blow said launch tube covers off of selected ones of said launch tubes to expose said torpedoes contained therein to said water.

12. The method of claim 11 further comprising the steps of:

deploying a tether line attached to said anchor section from a cable reel in a deployment hardware section in said elongate container section; and vertically extending said elongate container above said bottom from said anchor section at the bottom of said water.

13. The method of claim 12 wherein said step of generating appropriate launch control signals in said main controller unit for launching said torpedoes includes the step of:

launching selected torpedoes substantially simultaneously.

14. The method of claim 12 wherein said step of generating appropriate launch control signals in said main controller unit for launching said torpedoes includes the step of:

launching selected torpedoes at time-spaced intervals.

* * * * *